US006499598B2

(12) United States Patent
Montepiani et al.

(10) Patent No.: US 6,499,598 B2
(45) **Date of Patent: *Dec. 31, 2002**

(54) EASY OPENING SYSTEM FOR SHRUNK HERMETIC BAGS

(75) Inventors: Mauro Montepiani, Milan; Massimo Rigoni, Baceno, both of (IT); Hughes Wygaerts, Oud-Turnhout (BE)

(73) Assignee: Cryovac, Inc., Duncan, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/878,441

(22) Filed: Jun. 11, 2001

(65) Prior Publication Data

US 2001/0025803 A1 Oct. 4, 2001

Related U.S. Application Data

(63) Continuation of application No. 09/441,176, filed on Nov. 15, 1999, now Pat. No. 6,260,705.

(51) Int. Cl.[7] ..... B65D 71/08

(52) U.S. Cl. ..... 206/497; 206/522; 206/806; 383/3; 383/9; 383/200

(58) Field of Search ..... 383/9, 10, 67, 383/200, 3; 206/497, 524.8, 806, 522; 53/441, 442

(56) References Cited

U.S. PATENT DOCUMENTS

| | | | | | |
|---|---|---|---|---|---|
| 2,245,738 | A | * | 6/1941 | Taylor | 383/200 |
| 3,354,795 | A | * | 11/1967 | Kugler | 383/9 |
| 3,554,435 | A | * | 1/1971 | Martinez | 383/9 |
| 3,578,239 | A | | 5/1971 | Periman | |
| 3,615,711 | A | * | 10/1971 | Markus et al. | 383/200 |
| 3,663,239 | A | * | 5/1972 | Rowe et al. | 383/200 |
| 4,555,025 | A | * | 11/1985 | Weinberg et al. | 206/497 |
| 4,576,283 | A | * | 3/1986 | Fafournoux | 206/524.8 |
| 4,764,028 | A | * | 8/1988 | Wood et al. | 206/497 |
| 5,493,845 | A | | 2/1996 | Adolf et al. | |
| 6,260,705 | B1 | * | 7/2001 | Montepiani et al. | 206/497 |

FOREIGN PATENT DOCUMENTS

| | | | | |
|---|---|---|---|---|
| EP | 0 078 761 A2 | | 5/1983 | |
| EP | 0 372 886 A2 | | 6/1990 | |
| EP | 0 745 539 A1 | | 4/1996 | |
| FR | 2009866 | | 2/1970 | |
| JP | 40-4339767 | * | 11/1992 | 383/9 |
| NL | 6900418 | | 7/1970 | |

* cited by examiner

*Primary Examiner*—Bryon P. Gehman
(74) *Attorney, Agent, or Firm*—Rupert B. Hurley, Jr.

(57) ABSTRACT

A pouch made from a heat-shrinkable, gas-barrier, thermoplastic film is suitable for packaging one or a plurality of items. The pouch has a bottom, two closed side edges, and an open mouth for the introduction of the items to be packaged. The pouch has a first seal connecting the two side edges, the seal being between the bottom of the pouch and the mouth of the pouch. The first seal, portions of the side edges, and the bottom together define a first area. The pouch has a second seal which extends toward the first seal, with the second seal and the bottom defining a second area. The second area has a precut which extends from the bottom toward the second seal.

7 Claims, 2 Drawing Sheets

EASY OPENING SYSTEM FOR SHRUNK HERMETIC BAGS

This is a continuation of U.S. Ser. No. 09/441,176, filed on Nov. 15, 1999, now U.S. Pat. No. 6,260,705.

The invention relates to a pouch or bag of a heat shrinkable gas-barrier, thermoplastic film for packaging one or a plurality of items and to a method of packaging an article in this pouch or bag.

Specifically the invention relates to an easy openable bag or pouch for vacuum shrink packaging characterized by the fact that it has two hems that can be easily gripped, facilitating the opening.

One of the packaging methods that are in common practice today is vacuum shrink packaging, according to which an article of interest is wrapped with a heat-shrinkable thermoplastic film, that is in the form of a bag, a sheet folded in two or the like and the package is vacuumised, heat sealed and cut off along the edge portions. The obtained package is heat shrunk to provide a tight appearance. The heat shrink packaging is gaining increased popularity because it adds to the aesthetic appeal of the packaged articles, thereby enhancing their commercial value and it permits easy packaging of articles even if they have complex shapes.

On the other hand, packages overwrapped in heat-shrinking film have the disadvantage that overpwraps stick so closely to the underlying surfaces and are in such tension that they are difficult to tear when the package must be torn open.

Various methods have so far been proposed with a view to overcoming this problem and facilitating the opening of packages that are made of heat shrunk films. Said methods include: i) forming a line of perforations in a specified position on a heat shrinkable film so that one can open the package by tearing it along said line; ii) making a U-shaped hole in a specified site on the film and attaching a paper seal over the hole to form a seal label that serves as an aid in opening the package; and iii) additionally attaching a so-called "opening tape".

However these conventional methods have their own limitations. In the first approach, the perforations will grow in size upon heat treatment of the heat shrinkable film and contaminants can potentially get into the package through the holes, thereby reducing the commercial value of the contents. In some cases, the perforations may rupture during handling. The second approach needs a special apparatus for making the U-shaped hole and, furthermore, the use of paper seals adds to the production cost. These two methods are not suited to vacuum packages. The third approach has the inherent disadvantage of being cumbersome.

One further easy opening system available for heat shrunk bags is disclosed in EP-A1-745539 where a heat shrinkable film wrap for a food product has an edge zone isolated from the remainder by a seal between opposed film layers, and a cut extending inwardly in the zone from one edge to form a tongue when heat-shrunk to facilitate opening. The film is wrapped around the product, heat sealed peripherally and then heat-shrunk. The zone is preferably separate from and adjacent to the package closure heat seal, and may be heat-sealed peripherally or over its entire area. The film may be a bag for packaging the product under vacuum, or allow packaging under a modified atmosphere.

This system has the disadvantage that, when shrunk, the protruding tongue is not visible and is difficult to grip, thus leading to an unpleasant appearance and sometimes even to an accidental break of the package. There is therefore the need for a sure easy opening system with a better packaging appearance.

The inventors have found that when in a vacuum packaging process a bag or a pouch is employed comprising a seal along a line, in-between the bottom and the mouth connecting the two side edges and defining with the closed bottom of the bag or pouch and part of the side edges a closed, airtight area, said closed bottom also comprising another seal extending from the closed bottom inward the closed, airtight area; the two hems, that are thus created, can be pulled one backward and the other forward to open the package.

The airtight area may also contain an amount of gas, typically air, such that it balloons upon heat treatment creating two pillow shaped hems having a better packaging appearance. The gas present in the airtight area may also reduce the shrinkage of the thermoplastic film in that area.

DRAWINGS

In the drawings which are attached hereto and make part of this disclosure:

Figure 1:
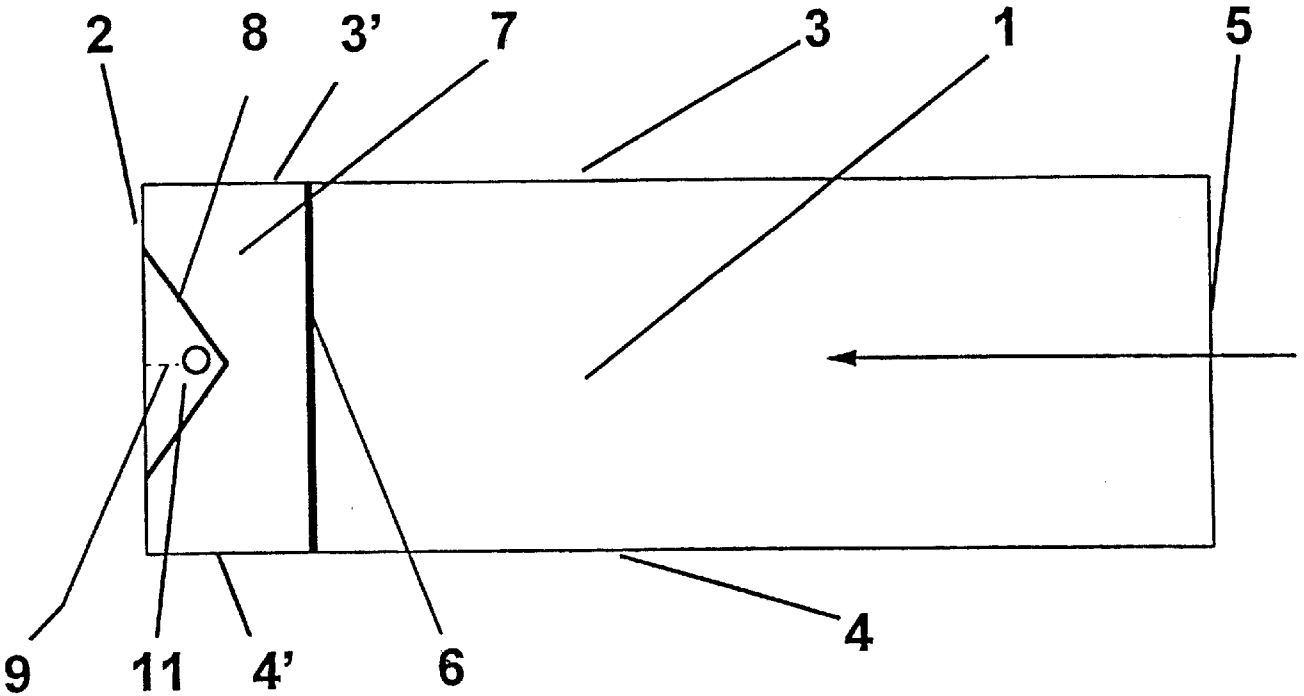
FIG. 1 is a top view of a shrink bag according to a particular embodiment of the present invention, wherein the arrow indicates the product loading direction.

The following reference characters are used in the Figures:

1. bag or pouch
2. closed bottom of the package
3. first side edge of package
4. second side edge of package
3'. part of the side edge defining with 4', 5 and 6 the closed airtight area 7
4'. part of the side edge defining with 3', 5 and 6 the closed airtight area 7
5. mouth of the bag
6. second seal
7. airtight area
8. seal
9. precut
10. hems
11. hole Like reference characters are used to identify like or corresponding features throughout the several views.

SUMMARY OF THE INVENTION

Referring to these figures, a first object of the present invention is therefore a pouch or bag (1) of a heat shrinkable gas-barrier, thermoplastic film for packaging one or a plurality of items, said pouch or bag comprising a closed bottom (2), two closed side edges (3) and (4) and an open mouth (5) for the introduction of the items to be packaged, said pouch or bag being characterized in that it comprises a seal (6) along a line, in-between the bottom (2) and the mouth (5), connecting the two side edges (3) and (4), said seal (6) defining with the closed bottom (2) and part of the side edges (3') and (4') a closed, airtight area (7) and in that it further comprises another seal (8) extending from the closed bottom (2) toward the closed, airtight area (7) and a precut (9) made in the area delimited by the bottom (2) and the seal (8). Preferably seal (6) is parallel to bottom (2).

A particular embodiment of the present invention is the above mentioned pouch or bag wherein the airtight area may also contain an amount of gas, such that it balloons upon heat treatment creating two pillow shaped hems having a better packaging appearance.

A second object of the present invention is an easy to open, heat-shrunk, vacuum package characterized in that the product is introduced into the above mentioned pouch or bag that is then vacuumised, the mouth (5) is then sealed and the package is submitted to a heat treatment.

DEFINITIONS

As used herein, the term "homopolymer" is used with reference to a polymer resulting from the polymerization of a single monomer, i.e., a polymer consisting essentially of a single type of repeating unit.

As used herein, the term "copolymer" refers to polymers formed by the polymerization reaction of at least two different monomers.

As used herein, the term "polymer" refers to both homopolymers and co-polymers as defined above.

As used herein, the phrase barrier "layer", is used with reference to the ability of a film layer to substantially reduce the film permeability to gases such as oxygen and carbon dioxide. Typically, barrier layers comprise a barrier resin such as PVDC or EVOH.

As used herein the term "heat-shrinkable" refers to films showing a % free shrink of at least 15%, in at least one direction, when heated, unrestrained, at a temperature of 120° C. for 4 seconds in accordance to ASTM D 2732, as set forth in the 1990 Annual Book of ASTM Standards, Vol. 08.02, pp. 368–371.

DETAILED DESCRIPTION

While the invention will be described in connection with one or more preferred embodiments, it will be understood that the invention is not limited to those embodiments. On the contrary, the invention includes all alternatives, modifications, and equivalents as may be included within the scope of the appended claims.

Referring to FIG. 1, a first object of the present invention is a pouch or bag (1) of a heat shrinkable gas-barrier, thermoplastic film for packaging one or a plurality of items, said pouch or bag comprising a closed bottom (2), two closed side edges (3) and (4) and an open mouth (5) for the introduction of the items to be packaged, said pouch or bag being characterized in that it comprises a seal (6) along a line, in-between the bottom (2) and the mouth (5), connecting the two side edges (3) and (4), said seal (6) defining with the closed bottom (2) and part of the side edges (3') and (4') a closed, airtight area (7) and in that it further comprises another seal (8) extending from the closed bottom (2) toward the closed, airtight area (7) and a precut (9) made in the area delimited by the bottom (2) and the seal (8).

The film used is a mono- or bi-axially oriented, heat shrinkable film.

Mono- or bi-axially oriented heat-shrinkable films are typically made by extruding or coextruding polymers from a melt into a thick film, followed by a quick quenching to prevent or delay crystallization and by orientation of the thick film by stretching it, either monoaxially or biaxially, under temperature conditions where molecular orientation of the film occurs and the film does not tear. Upon subsequent re-heating at a temperature close to the orientation temperature it will tend to shrink in seeking to recover its original dimensional state. Bi-axially oriented heat-shrinkable films can be obtained by extruding or co-extruding the polymer(s) through a round die giving a tubular thick film called "tape", that is immediately and quickly quenched by means of a water bath or cascade typically to about room temperature. Said tape is then heated at the orientation temperature and stretched biaxially, while at this temperature, e.g. by the so-called "trapped bubble" technique that uses internal gas pressure to expand the diameter of the tape to form a large "bubble" and advancing the expanded tube at a faster rate than the extrusion rate so as to obtain transverse and machine directions of orientation respectively. Usually the stretch is at least about 3× in each direction. The film is then cooled and rolled up in the cooled state so as to retain the property of heat-shrinkability. The orientation temperature range generally depends on the type of polymers employed. The orientation temperature used for the manufacture of heat-shrinkable films is in any case lower than the melting temperature of at least one polymer present in the film. Alternatively mono- or bi-axially oriented heat-shrinkable films can be obtained by extruding the polymers through a flat die in the form of a sheet, and after a quenching step, heating the sheet to the orientation temperature and stretching it. Longitudinal orientation is generally obtained by running the sheet over at least two series of pull rolls wherein the second set runs at a higher speed than the first one. Cross-wise or transversal orientation is generally done in a tenter frame where the edges of the sheet are grasped by clips carried by two continuous chains running on two tracks that move wider apart as they go along. When bi-axially oriented films are desired, in alternative to a sequential stretching, i.e. either longitudinal first and then transversal or vice-versa, the stretching may be simultaneous in both directions. The stretched film is then cooled and rolled up as usual. Also in the case of orientation by a tenter frame the stretch is usually at least about 3× in each direction, but higher ratios are also common.

The films used will typically be made of a multilayer structure comprising a gas barrier layer, such as for instance a layer comprising PVDC, EVOH, a poly- or copolyamide, etc. as known in this field. Other layers may clearly be present in order to provide the structure with the thickness and the mechanical properties required.

Those skilled in the art will understand that a package can have various shapes; can have rounded, straight or irregular edges; one or more of these are typically heat sealed. Bags normally include one or two factory seals, and one or two folded edges: one edge, the open mouth of the bag adapted to receive an article, is heat sealed after loading the article into the bag.

In the "transverse seal bag" (TS bag) machines the bags are formed by laying flat a tubing of a thermoplastic film. Thereafter the film enters in an unwinding station followed by an hydraulic system for the definition of the size of the bag. This is followed by an impulse sealing forming the side edges (3) and (4) of the bag and a knife precutting station, that cuts the tube and forms the mouth (5) of the bag. The precut serrated chain goes through a bag separation station and the formed bags are placed and aligned on a conveyor belt forming a bag chain that can be eventually taped and boxed. Thereafter the article is placed in the bags and these are vacuumised, sealed and heat shrunk to complete a tight package.

Alternatively the closed side edges (3) and (4) are formed by laying flat a tubing of a thermoplastic film and the closed bottom (2) is formed by heat-sealing. In the "end seal bag" (ES bags) machines the flattened tape enters in an unwinding station followed by an impulse sealing and a knife cutting station. Formed bags are then placed and aligned on a conveyor belt by a mechanical and pneumatic device. A taping station allows to have a collated bag chain.

Bags or pouches according to the present invention are also made by using the horizontal form fill machines. Such packings are made from a heat shrinkable gas-barrier, thermoplastic film for packaging one or a plurality of items, shaped into a tube by a longitudinal sealing while at the same time the article to be packed is inserted into this tube. Thereafter the tube is closed at its two ends by two hermetic transverse heat sealings. This type of packs may also be made under modified atmosphere.

These systems are per se conventional and well known in the art. Bags according to the present invention are made with these or other methods and have a further seal (6) made along a line, in-between the bottom (2) and the mouth (5), connecting the two side edges (3) and (4), said seal (6) defining with the closed bottom (2) and part of the side edges (3') and (4') a closed, airtight area (7). A seal (8) extending from the closed bottom (2) inward the closed, airtight area (7) is made before or in conjunction or subsequently to the previously described seal. The seal (6) which is indicated in the attached figures as a straight line could also be rounded or have any particular shape connecting the side edges of the packaged product. The seal (8) may have a V or Y or rounded shape, preferably it has a V shape and is preferably made at an equal distance from both the side edges as shown in FIG. 1, in order to create two distinct hems upon heat treatment. Pulling one hem forward and the other backward the package is easily opened.

The seal (6) may be made on preformed bags by means of a device or kit able to form at the same time the seal (6) and the easy opening seal (8). The seal (6) is preferably an impulse seal.

Before, in conjunction or after the seal (8) is made, a precut (9) is also made in the area delimited by the bottom (2) and the seal (8). This precut (9) may also be serrated. The package starts to tear from this precut (9). Preferably this precut (9) is made starting from the bottom (2) of the bag and extending toward the seal (8) itself.

In another preferred embodiment of the present invention the precut (9) may be made in form of a hole (11) made in the area delimited by the bottom (2) and the seal (8). The hole (11) may be useful for hanging the package, and at the same time may be shaped in order to initiate from it the opening of the package instead of using the precut (9). Alternatively the hole (11) may be made in addition and next to the precut (9).

The seal (6), the seal (8) and the precut (9) may be made also during the bag making.

Shrink bags according to the present invention may be also printed or coloured.

In a particular embodiment of the present invention shrink bags according to the present invention may also have printed or drawn arrows or drawings to indicate how to pull the hems to open the package.

In a particular embodiment of the present invention no gas is blown into the bag or pouch during the bagmaking, but the two hems created by the seals (6) and (8) and the precut (9) assure a good easy opening of the package.

A preferred embodiment of the present invention is the above mentioned pouch or bag wherein the airtight area may also contain an amount of gas such that it balloons upon heat treatment creating two pillow shaped hems having an easier openability of the package and a better packaging appearance. The gas present in the airtight area may also reduce the shrinkage of the thermoplastic film in that area.

Figure 2:
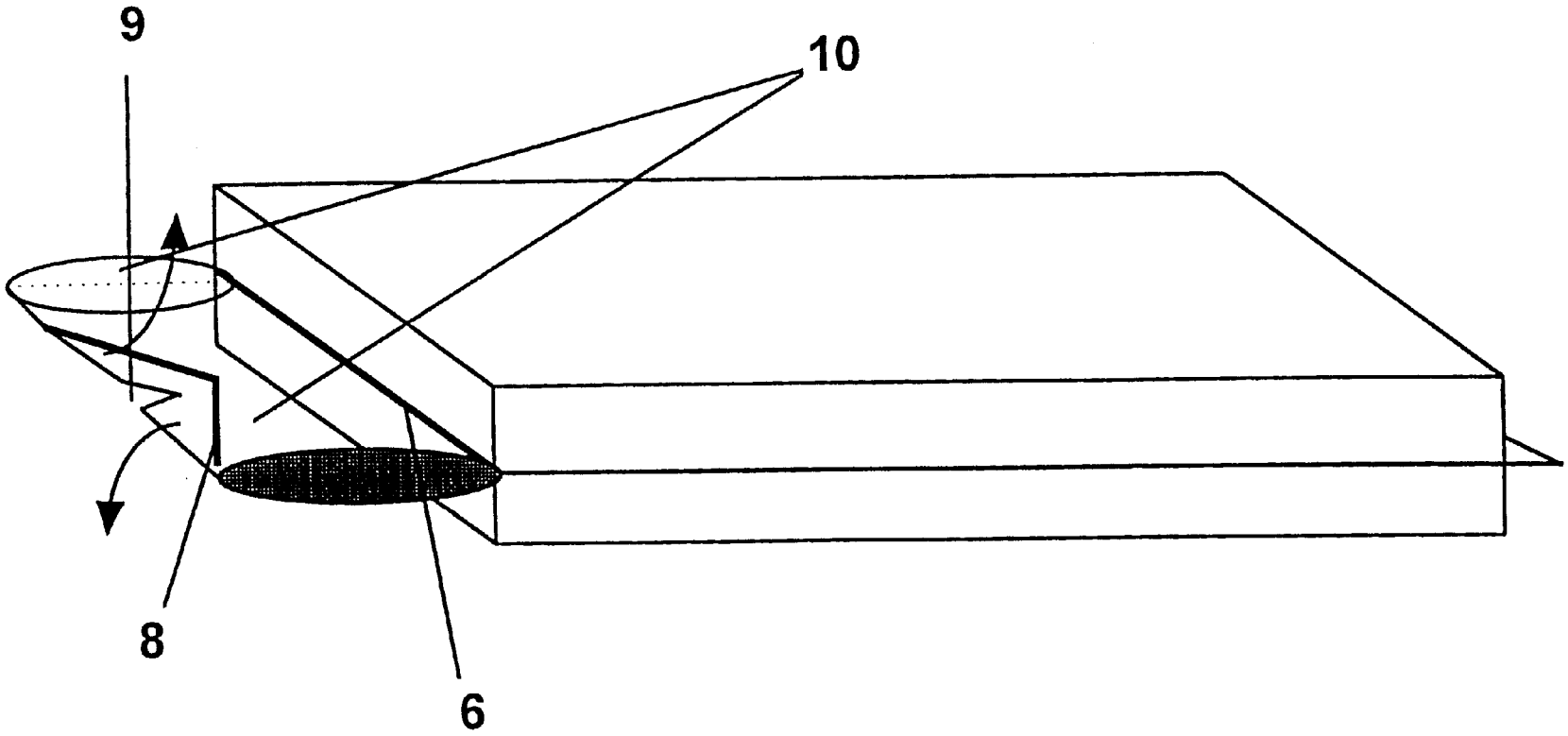
FIG. 2 is a perspective view showing the bag with the hems, wherein the arrows indicate how to pull the two hems in order to open the bag.

Referring to FIG. 2, the two pillow shape hems are indicated as (10). To obtain this effect the airtight area (7) contains an amount of gas preferably comprised between from about 0.1 cc/ 0.5 $cm^2$ of airtight area to about 0.1 $cm^3$ /0.5 $cm^2$.

With a lower amount of gas the packaging appearance will be inferior as the two hems will not have a pillow shape. When a higher amount of gas is contained in the airtight area the package may rupture particularly during the shrinkage, but also during the stacking of bags.

The easy opening according to said particular embodiment of the present invention is made on TS and ES bags by introducing some gas, typically air, in the bag. In a particular embodiment of the present invention the gas may be introduced in the bag during the bag making, after the seal (8) has been made. Thereafter the seal (6) is made. In another particular embodiment of the present invention the seal (6) may be made before and then the precut (9); the gas, typically air may be introduced from the precut (9), and thereafter the seal (8) is made. In another particular embodiment of the present invention the gas may be introduced through the precut after this is made. Thereafter the seals (6) and (8) are made simultaneously or sequentially.

The gas may be introduced by means of a small nozzle, or by means of a fan, or by means of suction pads applied to the sides of the bag, wherein the vacuum created by the suction pads causes the separation of the bags sides and the introduction of gas between these. The introduction of gas may be also helped by a roller.

The easy opening according to said particular embodiment of the present invention is made on bags formed by the form fill seal machine by making the seals (6) and (8) and the precut (9) at the same time or sequentially with the seal closing the packages, while loading the product. In this type of packages, formed by a thermoplastic film shaped into a tube, the airtight area delimited by the seal (6) and (8) and by the side edges (3') and (4') will already contain an amount of gas sufficient to create two pillow shaped hems upon heat treatment and there will be therefore no need of inflating additional gas.

A second object of the present invention is an easy to open, heat-shrunk, vacuum package characterized in that a product is introduced into a pouch or bag according to the present invention, said pouch or bag is then vacuumised, the mouth (5) is sealed and the package is submitted to heat treatment.

Other methods of making bags and packages are known and may be readily adapted to use.

This invention can be used in conjunction with all currently available packaging equipment.

The following examples serve to further illustrate the invention which, however is not limited thereto.

EXAMPLES

In order to have identical conditions for the comparison of the behavior of the different samples the chemical compositions of the film forming the bags were held identical.

Different samples were prepared to compare shrink bags without easy opening and shrink bags with the new easy opening system. The samples were judged by 44 panelists from an appearance and functionality point of view.

Some articles were packed into different bags and presented to the panelists:

A. shrink bag without an easy opening system

B. shrink bag with the easy opening system according to the present invention obtained without blowing gas inside the airtight area.

C. shrink bag (FIG. 1) with the easy opening system according to the present invention and a quantity of gas of about 0.2 cc/cm$^2$ of airtight area.

These bags were presented, with a random sequence, to the panelists to be opened using only the hands and they were invited to cross out their choice. Then, a judgment was made on each pack on the facility in opening it. At the end the panelists were invited to say which packs opened more easily.

None of the panelists had difficulty in finding where and how to initiate the tearing to open both B and C.

No accidental opening during the test was recorded. In general the judgment is in favor of the EZO system with gas into the two hems (pack C) that allows a better grip thereof and an easier opening of the packages; and in particular they seem to be made on purpose; regarding the packs C the easy-opening system does not negatively affect the general package appearance and in most cases these ones were considered to improve the package appearance with respect to the traditional ones.

The appearance of packd C was judged to be better than that of packs B by 70% of the panelists and comparable by 18% of the panelists.

What is claimed is:

1. A pouch of a heat-shrinkable, gas-barrier, thermoplastic film for packaging at least one item, said pouch comprising:

a) a bottom;

b) first and second closed side edges;

c) an open mouth;

d) a first seal disposed between the bottom and the open mouth, the first seal connecting the first and second closed side edges;

e) a first area defined by the first seal, the bottom, and a portion of the first and second closed side edges;

f) a second seal, at least a portion of which extends toward the first seal;

g) a second area between the bottom and the second seal; and h) a precut made in the second area, the precut extending from the bottom toward the second seal.

2. The pouch according to claim 1, wherein a hole is disposed in the second area.

3. The pouch according to claim 1, wherein the precut is in the form of a hole.

4. The pouch according to claim 1, wherein the first seal is parallel to the bottom.

5. The pouch according to claim 1, wherein the second seal has a V shape.

6. The pouch according to claim 1, wherein the precut is serrated.

7. The pouch according to claim 1, wherein the precut is a straight cut.

* * * * *